US007287340B2

(12) United States Patent
Talbott

(10) Patent No.: US 7,287,340 B2
(45) Date of Patent: Oct. 30, 2007

(54) ENERGY TRANSLATING MECHANISM INCORPORATED INTO FOOTWEAR FOR ENHANCING FORWARD MOMENTUM AND FOR REDUCING ENERGY LOSS

(75) Inventor: Daniel Talbott, Portland, OR (US)

(73) Assignee: Sydney Design Technologies, Inc., Lafayette, LA (US)

( * ) Notice: Subject to any disclaimer, the term of this patent is extended or adjusted under 35 U.S.C. 154(b) by 104 days.

(21) Appl. No.: 10/847,731

(22) Filed: May 18, 2004

(65) Prior Publication Data

US 2004/0205983 A1 Oct. 21, 2004

Related U.S. Application Data

(63) Continuation-in-part of application No. 10/045,299, filed on Oct. 23, 2001, now abandoned.

(60) Provisional application No. 60/242,742, filed on Oct. 23, 2000.

(51) Int. Cl.
*A43B 5/00* (2006.01)

(52) U.S. Cl. ..... 36/25 R; 36/129; 36/114

(58) Field of Classification Search ..... 36/129, 36/103, 114, 25 R, 31
See application file for complete search history.

(56) References Cited

U.S. PATENT DOCUMENTS 3,936,956 A * 2/1976 Famolare, Jr. ..... 36/32 R
4,030,213 A * 6/1977 Daswick ..... 36/30 R
4,041,619 A * 8/1977 Sapper ..... 36/25 R
4,241,523 A * 12/1980 Daswick ..... 36/30 R
4,348,821 A * 9/1982 Daswick ..... 36/103
RE31,173 E * 3/1983 Daswick ..... 36/30 R
4,631,842 A * 12/1986 Koskela ..... 36/103
5,579,591 A * 12/1996 Kousaka et al. ..... 36/31
5,592,757 A * 1/1997 Jackinsky ..... 36/114
6,119,373 A * 9/2000 Gebhard et al. ..... 36/114
6,266,897 B1 * 7/2001 Seydel et al. ..... 36/29
6,393,735 B1 * 5/2002 Berggren ..... 36/129
2002/0026730 A1 * 3/2002 Whatley ..... 36/132
2002/0092201 A1 * 7/2002 Kraeuter et al. ..... 36/25 R
2002/0157279 A1 * 10/2002 Matsuura et al. ..... 36/25 R
2003/0192199 A1 * 10/2003 Nakano et al. ..... 36/25 R
2005/0160625 A1 * 7/2005 Whatley ..... 36/25 R

* cited by examiner

*Primary Examiner*—Marie Patterson
(74) *Attorney, Agent, or Firm*—Karl I. Mullen

(57) ABSTRACT

The present invention provides soles, platforms, or inserts incorporated into footwear, preferably athletic footwear, designed to promote a more efficient running technique by an energy-translating sole comprising one or more angular displacement members, balance-thrust members, and counterbalance as well as conventional features. Systems and methods of the present invention promote more efficient running technique by facilitating foot-strike to occur at a point under and behind the runner's center of gravity. This may be accomplished, for example, by a foot-strike member, angular displacement member and balance-thrust member working cooperatively to displace the runner's center of gravity and translate gravitational, inertial and ground reaction forces, as well as muscular tension forces, into linear momentum.

6 Claims, 13 Drawing Sheets

ENERGY TRANSLATING MECHANISM INCORPORATED INTO FOOTWEAR FOR ENHANCING FORWARD MOMENTUM AND FOR REDUCING ENERGY LOSS

CROSS REFERENCE TO RELATED APPLICATIONS

This application is a continuation-in-part of application Ser. No. 10/045,299 filed on Oct. 23, 2001 now abandoned, which claims priority to provisional application No. 60/242,742, filed on Oct. 23, 2000, and to PCT patent application No. PCT/US01/51382, filed on Oct. 23, 2001, which also claims priority to provisional application No. 60/242,742, filed on Oct. 23, 2000. The priority of the prior applications is expressly claimed and their disclosures are hereby incorporated by reference in their entirety.

BACKGROUND OF THE INVENTION

1. Field of the Invention

The present invention relates to athletic shoe technology. More particularly, it relates to systems and methods for various forms of energy-translating soles, or platforms, or inserts, which are incorporated into footwear and are designed to more effectively transfer gravitational, inertial and ground reaction forces into linear momentum thereby promoting a more efficient running technique.

2. Description of the Related Art

Athletic shoe technology has undergone a revolution over the past thirty years, particularly in regards to improvements in running shoes, both for the professional and casual user. In general, the majority of advancements in running shoe technology have largely centered around support, shock absorption and energy efficiency. For example, U.S. Pat. No. 5,909,948 describes an athletic shoe sole having a lateral stability element to provide improved lateral support during heel-strike. U.S. Pat. Nos. 5,247,742 and 5,297,349 describe a cushioning sole for athletic shoes having a pronation control device incorporated into the midsole in order to increase the resistance to compression of the midsole from the lateral side to a maximum along the medial side, and U.S. Pat. No. 5,987,779 describes an athletic shoe having an inflatable tongue or bladder for a more secure fit.

A major focus in athletic shoe technology has centered on shock absorption. A number of patents describe various systems for shock absorption, such as air channels, miniature pumps, hydraulic systems, gas-filled bladders, elastomeric foam elements, pneumatic inflation devices and spring elements. The following are illustrative of such technologies: U.S. Pat. No. 5,598,645, U.S. Pat. No. 4,535,553, U.S. Pat. No. 5,325,964, U.S. Pat. No. 5,353,523, U.S. Pat. No. 5,839,209, U.S. Pat. No. 5,983,529 and U.S. Pat. No. 4,763,426.

Embodiments of the present invention are distinct from the athletic shoe technologies pertaining to additional support or shock absorption described above in that systems and methods of the present invention focus on locomotion efficiency.

There have been several shoe systems related to increasing energy efficiency during running, such as U.S. Pat. No. 4,358,902, which describes a thrust-producing shoe comprising a sole having fluid-filled cavities located in the heel and metatarsal portions with passageways interconnecting the fluid-filled cavities. As the heel cavity is compressed, fluid is forced through the passageways into the metatarsal cavities thereby providing shock absorption and forward thrust in the heel and metatarsal area.

U.S. Pat. No. 4,030,213 discloses a sporting shoe having an auxiliary sole member that is relatively thick under the toe portion and its outer surface is curved to form nearly a half circle at the forward extremity of the toe section and the rearward extremity at the ball of the foot is relatively flat. An additional embodiment describes a plurality of recesses within the sole of the shoe for housing a number of coil springs.

U.S. Pat. No. 4,506,460 describes a spring moderator for articles of footwear, wherein a high modulus moderator is positioned beneath the heel or forefoot with a cushioning medium beneath the moderator. The spring moderator operates to absorb, redistribute and store the energy of localized loads.

U.S. Pat. No. 4,936,030 provides an energy efficient running shoe having an energy-transmission mechanism in the heel portion of the sole to transmit the mechanical energy of heel impact to the storage/thrust mechanism in the front sloe portion, where it is stored and released during thrust. A number of embodiments are described having sophisticated systems employing lever arms, coils springs, hydraulic assemblies and the like for capturing and transferring mechanical energy.

U.S. Pat. No. 4,949,476 discloses a running shoe having a hard front sole for retaining gripping elements and, from the ball to the shank of the foot, an upwardly extending support cup on the outside of the shoe upper. The front sole extends into the shank portion of the shoe and covers a support wedge member. The wedge member extends from the ball of the foot to the shank and is progressively thicker towards the rear portion of the shoe. The wedge shaped member causes the foot to be brought into an extended position for emphasizing contact with the ground with the front outside ball region of the foot. This configuration serves to increase running efficiency by keeping the heel in an elevated position, which is the preferred attitude during sprinting.

U.S. Pat. No. 5,586,398 provides an article of footwear for more efficient running and walking wherein the contour of the outer sole at the heel is formed at a dihedral angle to the medial/forefoot portions in order to delay the instant of initial contact and thereby allow a longer length of foot flight and correspondingly longer stride length. An additional embodiment provides for friction management through materials selection, surface coatings, or surface treatments designed to affect friction across one or more interfaces between foot plantar surface and shoe insole.

U.S. Pat. No. 5,647,145 describes a sculptured sole for an athletic shoe comprising a plurality of forward support pads, rearward support lands, a layer of flexible resilient elastic material interconnecting various components, as well as a plurality of channels, grooves, slots and the like, which complement the natural flexing actions of the muscles of the heel, metatarsals and toes of the foot.

U.S. Pat. No. 5,680,714 discloses a trampoline effect athletic shoe having elastic return strips running across the sole of the shoe and supported above the bottom surface in a gap between the outsole and insole.

U.S. Pat. No. 5,829,172 relates to shoe soles of running shoes, particularly for 100 m sprints and the like. The object of the invention is to prevent the heel from touching the ground during running and thereby prevent a decrease in running efficiency. The sole comprises a thickly formed forefoot section for receiving spikes. A Reinforcing member provided in the ball region of the foot is integrated with reward-projecting medial and lateral ribs to form a wedge-shaped plane extending toward the heel. Medial and lateral ribs and reinforcing member form a wedge-shaped inclined plane extending form the ball to the arch of the foot, which serves to maintain the weight distribution of the runner over the ball of the foot and hold the heel of the foot in an elevated position.

U.S. Pat. No. 5,743,028 describes a spring-air shock absorption and energy return device for shoes in which a shoe heel insert is provided having a heel-shaped outer spring mechanism which serves as an internal spring housing wherein a plurality of compression springs are retained, and wherein the entire unit is filled with a pressurized gas and hermetically sealed.

U.S. Pat. No. 5,87,568 pertains to an athletic shoe wherein the sole has a rounded heel strike area and gently curved bottom that gradually thins towards the toe section to permit the runner to roll smoothly forward from the initial heel strike. Additional embodiments further provide for a shock-absorbing insert in the heel section.

U.S. Pat. No. 5,937,544 provides athletic footwear wherein the sole includes a foundation layer of semi-flexible material attached to the upper and defining a plurality of stretch chambers, a stretch layer and a thruster layer attached to the stretch layer such that interactions can occur between the foundation layer, stretch layer and thruster layer in response to compressive forces applied thereto so as to convert and temporarily store energy applied to regions of the sole by wearer's foot into mechanical stretching of the portions of the stretch layer into stretch chambers. The stored applied energy is thereafter retrieved in the form of rebound of the stretched portions of the stretch layer and portions of the thruster layer.

U.S. Pat. No. 6,006,449 and U.S. Pat. No. 6,009,636 relates to footwear having various forms of spring assemblies incorporated into the sole, which serve to absorb shock and transfer energy.

The foregoing and other known prior art have fundamental disadvantages in that they are not directed at improving efficiency by synchronizing the three basic phases of the human running cycle, seen illustrated in FIGS. 6A-6C with elements on the shoe that optimize momentum, efficiency, and fluidity of motion through the cycle. For example, prior art shoes place the wearer in a plantigrade stance, as shown in FIG. 7. Generally, a plantigrade stance is created between the balance of two points: one at the calcaneous and the other at the metatarsal/phalanges joints. Relative to the digitigrade stance provided through the novel embodiments of the present invention described below, plantigrade shoe systems are inefficient in that in subject the wearer of the shoe systems to greater breaking forces during running cycles.

Rather than hydraulic or pneumatic systems; mechanical spring and/or lever assemblies; resilient elastic bands; alteration of the heel-strike region; or reinforcing structures to maintain the heel in an elevated position, the present invention provides systems and methods that promote efficient running technique by providing a sole comprising a specially designed foot-strike member and balance-thrust member, which are integrated with a unique pivot and balance structure that displaces the wearer's center of gravity when running, thereby transferring gravitational, inertial and ground reaction forces, as well as muscular tension generation into linear momentum. Systems and methods of the present invention are an advance in the field of athletic shoe technology by providing a specialized sole design for redirecting the forces encountered during running into linear momentum, while reducing the shock and trauma to the body. The present invention provides novel footwear and components thereof for achieving a more efficient centering of mass that helps improve transfer of momentum energy to a stable platform for propulsion during toe-off (propulsion) phase of gait.

SUMMARY OF THE INVENTION

Systems and methods of the present invention provide energy-translating soles, platforms, or inserts for footwear, preferably athletic footwear, designed to promote a more efficient running technique. In one aspect, promoting a more efficient running technique is facilitated by an energy-translating sole comprising one or more of the following features: at least one foot-strike member, one or more angular displacement members and at least one balance-thrust member, as well as other conventional features.

In another aspect, systems and methods of the present invention promote more efficient running technique by facilitating foot-strike to occur at a point under and behind the runner's center of gravity. This is accomplished by the foot-strike member, angular displacement member and balance-thrust member working cooperatively to displace the runner's center of gravity and translate gravitational, inertial and ground reaction forces, as well as muscular tension forces, into linear momentum.

In a further aspect, systems and methods of the present invention provide one or more foot-strike members, which may be situated in any location along the longitudinal axis (X axis) of the energy-translating sole with a front zone extending into the forefoot area and a rear zone optionally extending into the heel section. Foot-strike member may encompass the entire heel to forefoot sections, and/or any region there between. The medial and lateral margins of foot-strike member may generally follow the natural contours of the foot, and in embodiments wherein foot-strike member extends rearwardly to the heel, foot-strike member generally follows the contour of the heel.

In yet another aspect, angular displacement member is generally located forward of foot-strike member, and is generally positioned in the forefoot or metatarsal area of the foot. The front margins of angular displacement member may extend well into the toe section of sole with the rear margin optionally extending along the longitudinal axis well into the arch section of the sole. In a related aspect, various embodiments employ specially configured angular displacement members to suit particular running needs.

In another aspect, angular displacement member may have any number and/or sort of traction-related features, such as, but not limited to, grooves, channels, ribs, points, raised projections of any sort, and the like.

In still yet another aspect, angular displacement member is geometrically designed to provide a pivoting zone, preferably running transversely in the Z-axis between medial and lateral margins. Pivot zone may be located at or near the sesamoidal line along the longitudinal axis (X-axis) within angular displacement member depending upon the particular embodiment. Preferred embodiments of the present invention have pivoting zone encompassing the metatarsal region of the foot at or near the sesamoid bones of the first metatarsal head.

In a further aspect, systems and methods of the present invention provide one or more balance-thrust members, which generally encompass the toe section of the sole. Alternative embodiments may provide at least one balance-thrust member further comprising a plurality of traction facilitating members, such as spikes, teeth, ridges, grooves and the like. Medial and lateral margins of balance-thrust member generally follow the natural contours of the anatomical features of the foot, but the overall configuration and orientation of balance-thrust member varies with each particular embodiment.

In yet another aspect, the present invention provides a plurality of embodiments specifically designed for different running needs, which is partially dictated by the speed and distance involved. Each particular embodiment has a unique configuration and orientation of foot-strike member, angular displacement member and balance-thrust members to accommodate the unique biomechanical requirements of various types of running.

Other aspects of the present invention provide systems and methods to effectively displace the runner's center of gravity and translate gravitational, inertial and ground reaction forces into linear momentum. In another aspect, the present invention provides a platform that provides a rotational base for dissipating the shock of foot strike, thereby providing a more comfortable running shoe, which helps reduce the risk of injury associated with forceful foot strike.

These and other objects, advantages, and features of this invention will become apparent upon review of the following specification and accompanying drawings.

DETAILED DESCRIPTION OF THE INVENTION

Figure 1A:
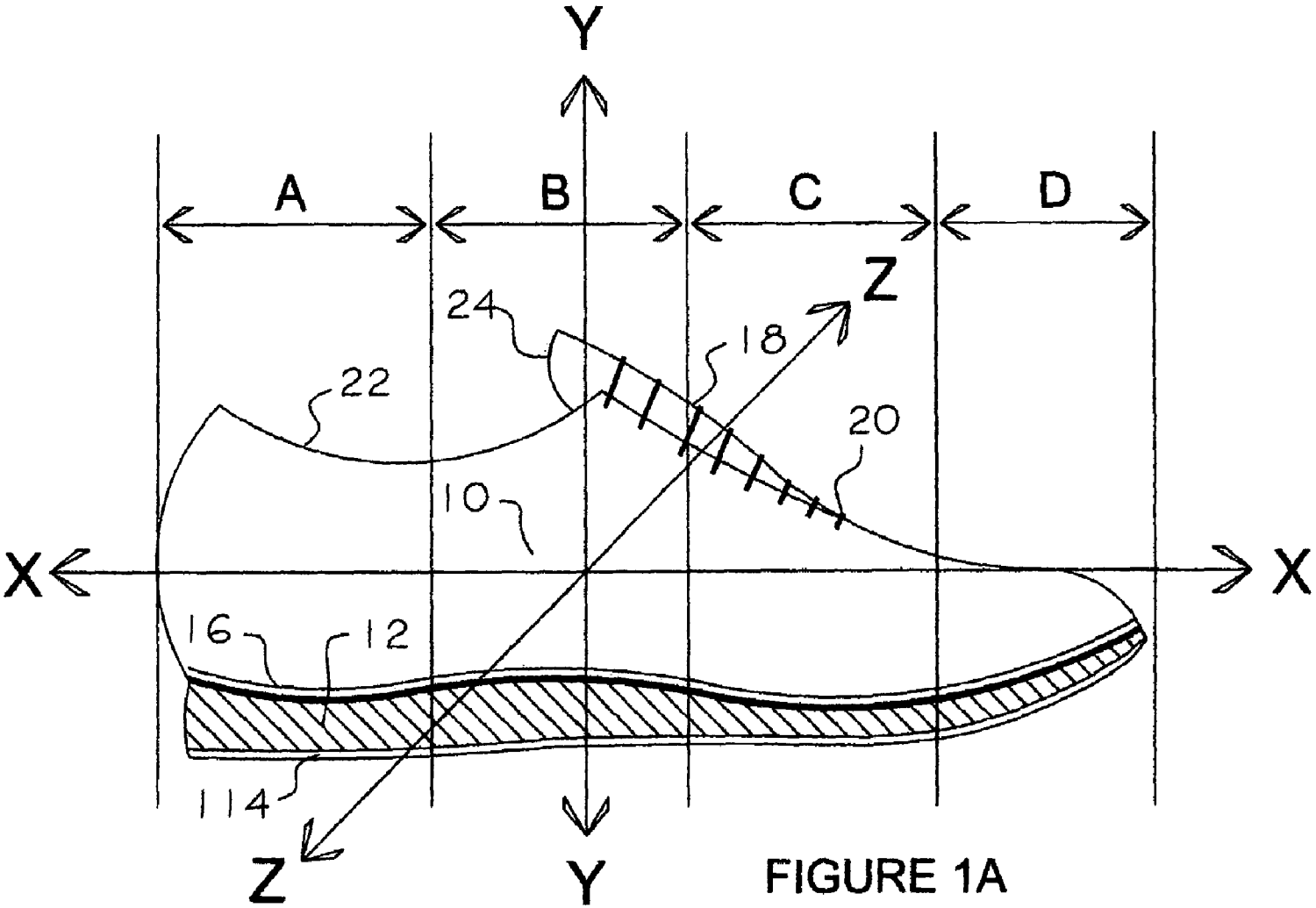
FIGURE 1A (Prior Art)
FIG. 1A shows a conventional shoe illustrating general features of a running shoe typically found in the prior art.

While the invention may be embodied in different forms to achieve more optimal centering of mass, the specific embodiments shown in the figures and described herein are presented with the understanding that they are exemplary of the principles of the invention and are not intended to limit the invention to that specifically illustrated and described herein. FIG. 1A shows a generic form of footwear comprising an upper, indicated generally as 10, and a sole unit which generally may comprise (i) a midsole for energy absorption and/or return; (ii) an outsole material for surface contact and abrasion resistance and/or traction; or (iii) a single unit providing such midsole or outsole functions. For example, the sole unit shown in FIG. 1A includes a midsole 12, an outsole 114 and an insole 16 on the interior lower surface of the footwear. The sole unit can cover some or all of the area of the supported foot.

As is well known in the art, the sole unit may include resilient elements that provide cushioning against shock. They may also be of a nature that provides energy return (in essence, spring) upon impact. For convenience, unless otherwise expressly or contextually indicated, "resilient element" refers to an element with either energy absorption and/or return functionality. One or more resilient elements may be included in a sole unit at locations where cushioning may be needed. For example, the rearfoot portion of the sole unit would typically require cushioning, and resilient element may be located there. Similarly, forefoot section may include one or more resilient elements.

Figure 1B:
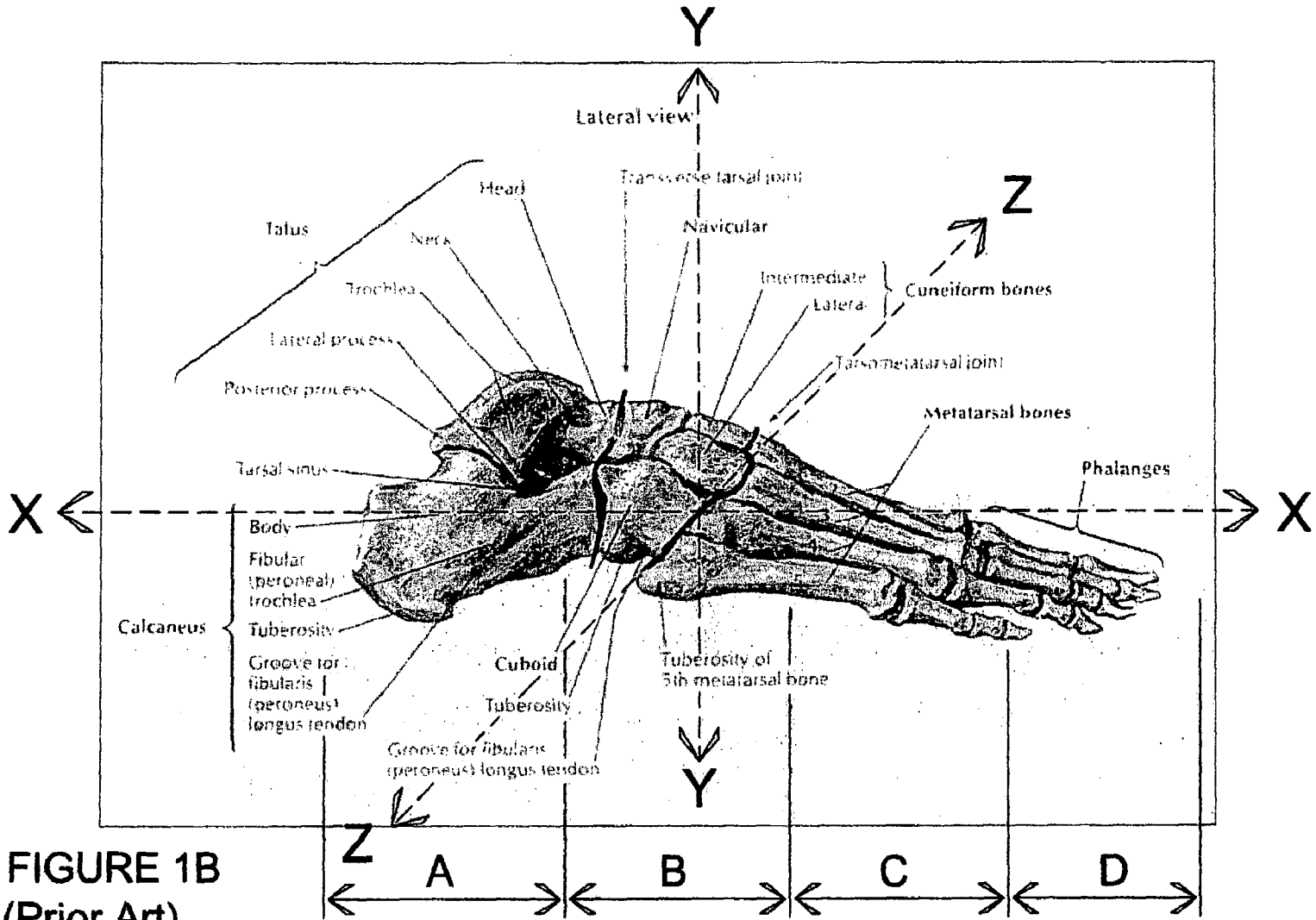
FIGURE 1B (Prior Art)
FIG. 1B is a lateral perspective of the skeletal system of the human foot depicting the various anatomical features in relation to conventional footwear.

The shoe illustrated in FIG. 1A has a conventional shoelace 18 engaged in eyelets 20. Upper 10 is partially split at the central, top portion of the footwear wherein lies some form of closure system 24, such as a conventional tongue. Collar 22 is provided to support the foot and/or ankle. Generally speaking, conventional shoes may be divided into heel (A), arch (B), ball or forefoot (C) and toe (D) regions. These elements of the footwear illustrated in FIG. 1A are generally conventional. Athletic shoes of the present invention comprise such conventional features, as well as others in conjunction with a specially designed sole system. FIG. 1B is a lateral perspective of the skeletal system of the human foot wherein the heel (A), arch (B), ball (C) and toe (D) regions of a conventional shoe align, in a general sense, with the anatomical structures depicted therein.

Figure 2:
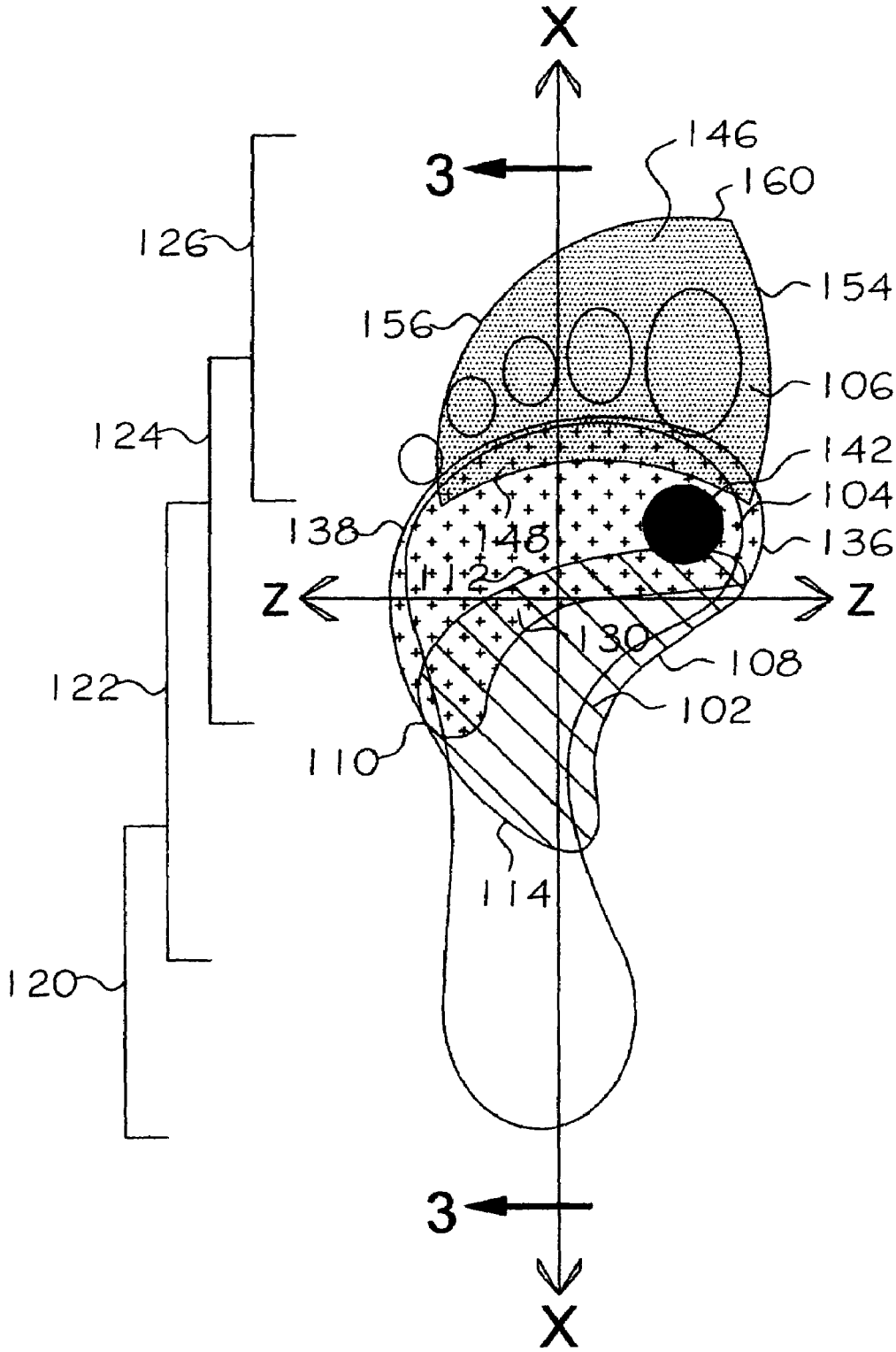
FIG. 2 shows a stylized plantar view of one embodiment of an athletic shoe sole of the present invention in spatial reference to the human foot.
Figure 3:
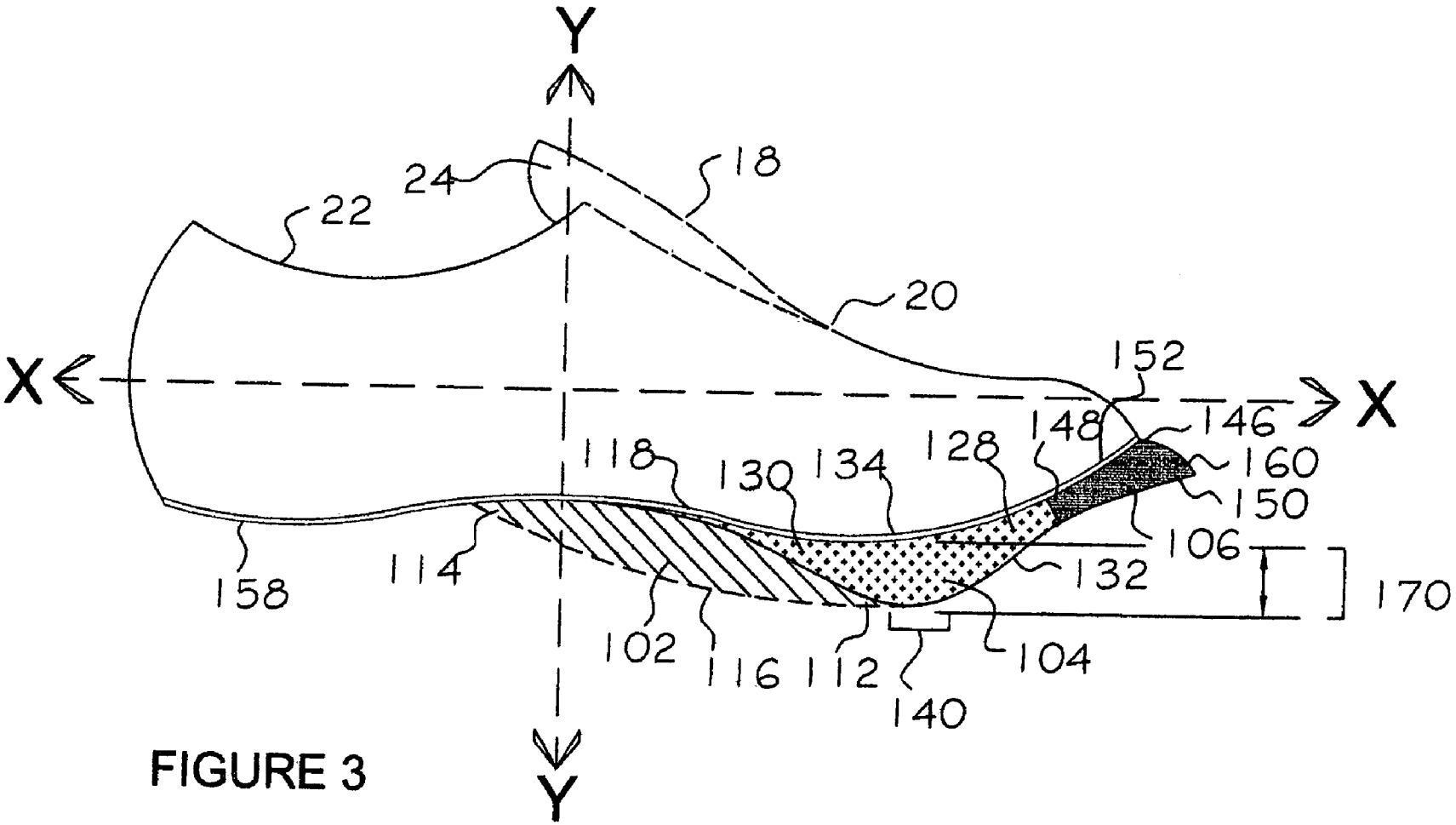
FIG. 3 is a cross-sectional side view of an athletic shoe employing systems of the present invention.

FIGS. 2-3 show a stylized plantar view of the first preferred embodiment of an athletic shoe sole, namely an energy-translating sole 100 of the present invention, in spatial reference to the human foot. FIG. 3 depicts a cross-sectional side view of the same embodiment. In certain broad aspects, systems and methods of the present invention provide an energy-translating sole unit, that is incorporated into shoes, preferably athletic shoes, including one or more of the following features: at least one foot-strike member 102, one or more angular displacement members 104, with its apex falling at or near the sesamoid apparatus medially and extending under lesser metatarsal heads laterally, and at least one balance-thrust member 106. As illustrated, there may be considerable overlap of the various members 102, 104, 106, but in alternative embodiments, members 102, 104, 106, may not necessarily have appreciable overlap. In general, systems and methods of the present invention promote more efficient running technique by facilitating foot-strike to occur at a point under and behind the runner's center of gravity. Foot-strike member 102, angular displacement member 104, and balance-thrust member 106 work cooperatively, creating a stable forefoot platform and smoother transition from footstrike to toe-off, and to displace the runner's center of gravity and translate gravitational, inertial and ground reaction forces, as well as muscular tension forces, into linear momentum.

As will be described in greater detail below, systems and methods of the present invention provide a plurality of embodiments specifically designed for different running needs, which is partially dictated by the speed and distance involved. The particular embodiment depicted in FIGS. 2 and 3 comprises footwear designed for running a mid-to-long distance sprint, such as a 400 m race. It is understood that the embodiment depicted in FIGS. 2 and 3 are merely illustrative of the general principles of the present invention and are not meant to be limiting in any respect.

Foot-strike member 102 is generally made of any conventional dense, semi-deformable, wear resistant material, such as synthetic polymers and plastics of any sort, having sufficient compliance and resiliency features to adequately absorb a relative portion of impact forces imparted to the shoe and body of the runner upon initial contact with a supporting surface. Various embodiments of the present invention may employ materials that are more suitable for that particular application. For example, an embodiment for distance running may utilize a material for foot-strike member 102 having greater indices of compliancy and resiliency than an embodiment for sprinting. Foot-strike member 102 comprises a front zone 112 (FIG. 3) (112 also is the location of the sesamoidal line referred to herein and in the claims as "sesamoidal line," which is generally the location of the sesamoid apparatus of the first metatarsal phalangeal joint) extending towards toe section 126 (FIG. 2) and a rear zone 114 extending towards heel section 120. In preferred embodiments, front zone of foot-strike member 112 (112 also is the location of the sesamoidal line referred to herein and in the claims as "sesamoidal line," which is generally the location of the sesamoid apparatus of the first metatarsal phalangeal joint)is arcuately formed to follow the natural anatomical features of the foot, but alternative embodiments also include additional configurations and foot-strike member rear zone 114 generally follows the anatomical margins of the foot, such as the arch and heel. Foot-strike member 102 may be situated in any location along the longitudinal axis (X axis) of sole 100 with front zone 112 (112 also is the location of the sesamoidal line referred to herein and in the claims as "sesamoidal line," which is generally the location of the sesamoid apparatus of the first metatarsal phalangeal joint) extending into forefoot section 124 rear zone 114 extending into heel section 120 and may encompass the entire heel 120 to forefoot 124 sections, and/or any region there between. The medial 108 and lateral 110 margins of foot-strike member 102 generally follow the natural contours of the foot, and in embodiments wherein foot-strike member 102 extends rearwardly to the heel, foot-strike member 102 generally follows the contour of the heel.

Foot-strike member 102 may be of a singular uniform molded composition or alternatively, be provided in a layered or composite configuration. Plantar surface 116 of foot-strike member 102 may be integral with and/or adjacent to any conventional outsole having any number and/or type of traction-related features, such as, but not limited to, grooves, channels, ribs, points, raised projections of any sort, and the like. Furthermore, foot-strike member 102 may further comprise any conventional pneumatic and/or hydraulic cells, bladders, chambers and the like to further facilitate and control shock absorption.

The configuration, dimensions and preferred construction materials of foot-strike member 102, as well as angular displacement member 104 and balance-thrust member 106, is largely dependent upon the particular embodiment. The embodiment presented in FIGS. 2 and 3 show foot-strike member 102 having a generalized elliptical form having a thickness ranging from 0.5 to 10 cm, with front zone 112 (112 also is the location of the sesamoidal line referred to herein and in the claims as "sesamoidal line," which is generally the location of the sesamoid apparatus of the first metatarsal phalangeal joint) tapering towards, and transitioning with and/or into angular displacement member 104 and rear zone 114 tapering and transitioning with and/or into one or more support bases 158 (also referred to herein and in the claims as the plantar surface of the substantially rigid member). Naturally, the tapered ends of foot-strike member may fall outside the provided ranges. Support base 158 may be integral with and/or adjacent to any conventional outsole having any number and/or type of traction-related features, such as, but not limited to, grooves, channels, ribs, points, raised projections of any sort, and the like.

Angular displacement member 104 is located forward, towards forefoot 124 and toe regions 126, of foot-strike member and is generally positioned in the forefoot or metatarsal area 124 of the foot. Front zone 128 of angular displacement member 104 is generally arcuately designed and may extend well into toe section 126 of sole 100 and rear zone 130 of angular displacement member 104 may extend along the longitudinal axis well into arch section 122 of sole 100. Alternative embodiments envision angular displacement member 104 being more compact, that is, encompassing less surface area, and more discreetly positioned over the metatarsal and/or metatarsal-phalanges areas of the foot. Dorsal surface 134 of angular displacement member 104 is integrated with or fixedly adhered to support base 158 (also referred to herein and in the claims as the plantar surface of the substantially rigid member). Plantar surface 132 of rear zone 130 of angular displacement member 104 is fixedly integrated with and/or adhered to dorsal surface 118 (also referred to herein and in the claims as the dorsal surface of the substantially rigid member) of front tapering zone 112 (112 also is the location of the sesamoidal line referred to herein and in the claims as "sesamoidal line," which is generally the location of the sesamoid apparatus of the first metatarsal phalangeal joint) of foot-strike member 102, such that a relatively smooth transition between foot-strike 102 and angular displacement 104 members is achieved and a strong, permanent bond or integral component is provided. In preferred embodiments, plantar surface 132 of angular displacement member 104 may have any number and/or sort of traction-related features, such as, but not limited to, grooves, channels, ribs, points, raised projections of any sort, and the like. Medial 136 and lateral 138 margins of angular displacement member 104 generally follow the natural anatomical profile of the foot and, preferably, flow smoothly into respective medial 108 and lateral 110 margins of foot-strike member 102.

Angular displacement member 104 is geometrically designed to provide a pivoting zone 140, preferably running transversely in the Z-axis between medial 136 and lateral 138 margins. Preferred embodiments of the present invention have pivoting zone 140 in the forefoot 124 region, and more preferably encompassing the metatarsal region of the foot at or near the sesamoidal line. Pivot zone 140 may be located anywhere along the longitudinal axis (X-axis) within angular displacement member 104 depending upon the particular embodiment. Pivot zone 140 may be variously shaped, but in preferred embodiments, is arcuately formed to follow the natural curvature and anatomical structures of the foot, such as, but not limited to, the metatarsal-phalanges articulations, as well as accommodate and exploit the natural lateral to medial rolling of the foot during running. Systems and methods of the present invention are designed to promote more efficient running technique by facilitating footstrike to occur at a point under and behind the runner's center of gravity. Foot-strike member 102, angular displacement member 104, and balance-thrust member 106 work cooperatively, creating a stable forefoot platform and smoother transition from footstrike to toe-off, and to displace the runner's center of gravity and translate gravitational, inertial and ground reaction forces, as well as muscular tension forces into linear momentum. During use of the present invention, the sesamoid apparatus 142 of the wearer's foot is generally elevated with respect to the digits 106 of the wearer's foot, resulting in a digitigrade stance.

Front zone of angular displacement member 128 is integral with, and/or fixedly adhered to, rear section 148 of balance-thrust member 106 in an overlapping or abutting manner. Balance-thrust member 106 is located forward (i.e., towards toe section 126) of angular displacement member 104 and generally encompasses the front part of forefoot section 124 and all of toe section 126 of sole 100. Depending upon the particular embodiment, balance-thrust member 106 may be formed of semi-deformable material or essentially non-deformable material, but in general, comprises a material having relatively less compliancy and resiliency than that of foot-strike member 102, such as conventional synthetic polymers and/or plastics, such that significant levels of kinetic and mechanical energy are not overly dampened by deformation of the material. In select embodiments, such as depicted in FIGS. 2 and 3, as well as others, balance-thrust member 106 may be provided with a plurality of traction-facilitating elements projecting from plantar surface 150 (150 also is the location of the balance thrust line referred to herein and in the claims as "balance thrust line"), such as, but not limited to, spikes, teeth, cleats, ridges and the like. Such traction-facilitating elements may be fixedly connected to, and/or releasably integrated with, and/or integrally formed from balance-thrust member 106 by any conventional methods. Choice of construction materials for balance-thrust member 106 should have sufficient hardness, as determined by conventional methods, to retain traction-facilitating elements and effectively transmit forces from sole 100 to supporting surface and vice versa.

Front zone 146 of balance-thrust member 106 extends up to, and in select embodiments, extends beyond, the phalanges distal margin of the first metatarsal bone. Front zone 146 of balance-thrust member 106 ends in a termination point 160, which may be in the form of traction facilitating members, such as spikes, teeth, ridges, grooves and the like, depending upon the particular embodiment. Termination point 160 may be variously located long the longitudinal axis (X-axis) of sole 100. For example, FIG. 2 depicts a shoe designed for mid-to-long distance sprinting and has termination point 160 at a downward-projecting angle and extending somewhat beyond the forward perimeter of support base 158 (also referred to herein and in the claims as the plantar surface of the substantially rigid member) and upper 10, but other embodiments, such as a distance shoe and/or jogging shoe, may have termination point extend even further beyond the forward perimeter of support base 158 (also referred to herein and in the claims as the plantar surface of the substantially rigid member) and upper 10 and not have as pronounced a downward projecting angle. Medial 154 and lateral 156 margins of balance-thrust member 106 generally follow the natural contours of the anatomical features of the foot. As with other aspects of the present invention, plantar surface 150 area of balance-thrust member varies with each particular embodiment (150 also is the location of the balance thrust line referred to herein and in the claims as "balance thrust line"). For purposes of example, select embodiments, such as in FIG. 2, lateral margin 156 may define a more focused balance-thrust member, that is, delineate plantar surface 150 area of balance-thrust member 106 to encompass the first through fourth metatarsal-phalanges areas of the foot, such that horizontal propulsive forces at toe-off are effectively focused on the most relevant parts of the foot (150 also is the location of the balance thrust line referred to herein and in the claims as "balance thrust line").

Figure 4A:
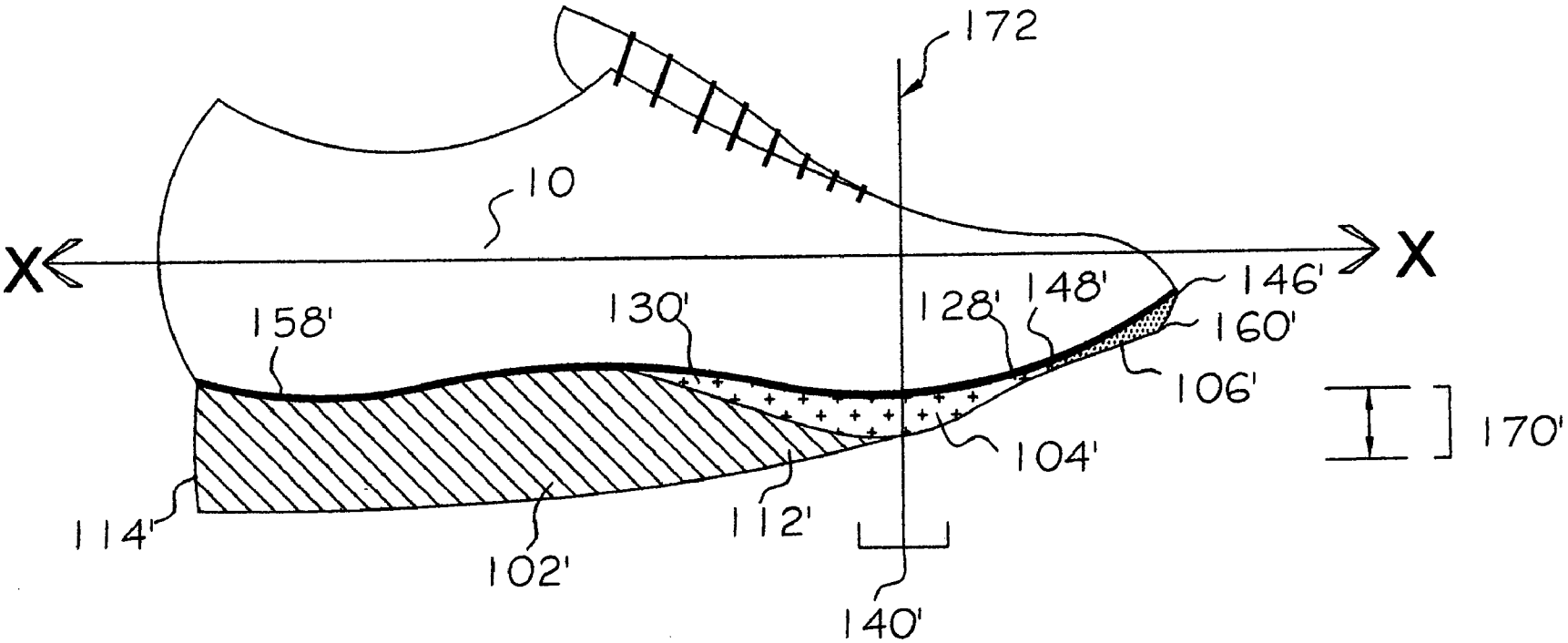
FIG. 4A is an alternative embodiment designed for distance running.
Figure 4B:
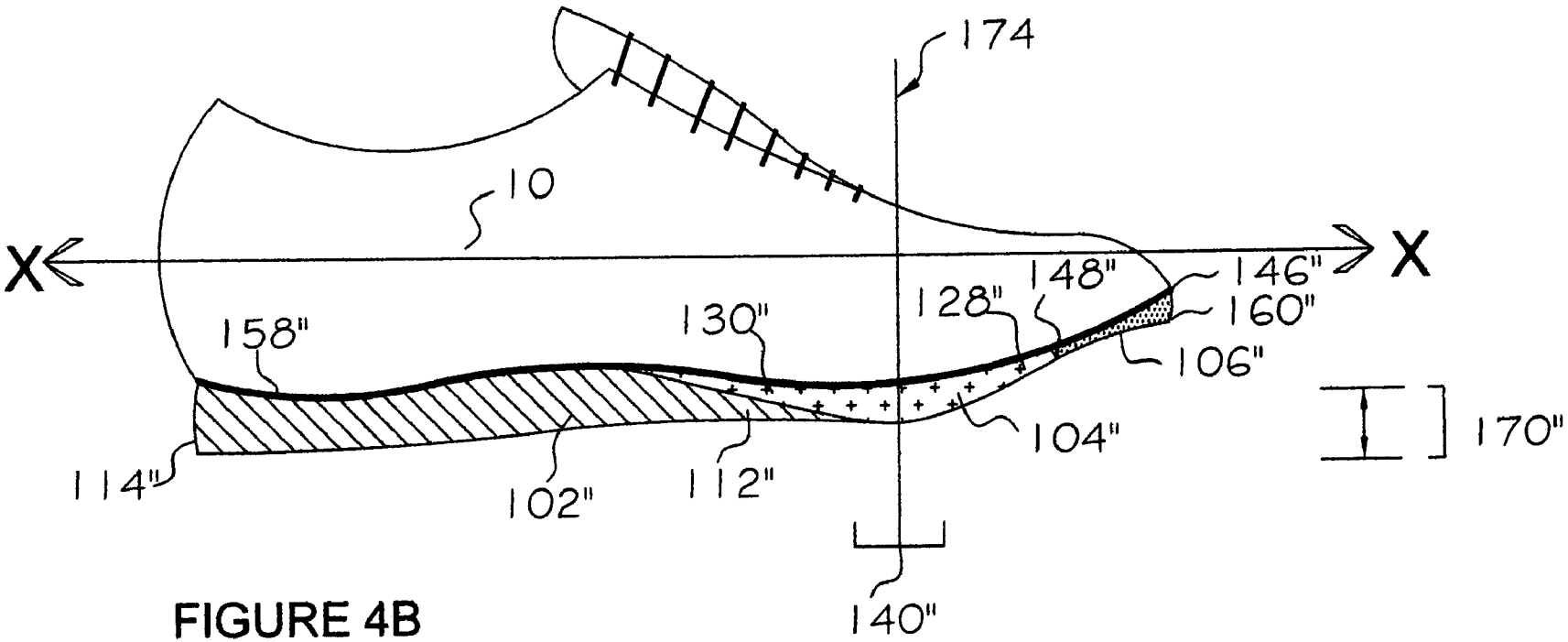
FIG. 4B is an additional embodiment designed for mid-distance running, such as a 1500 m race.
Figure 4C:
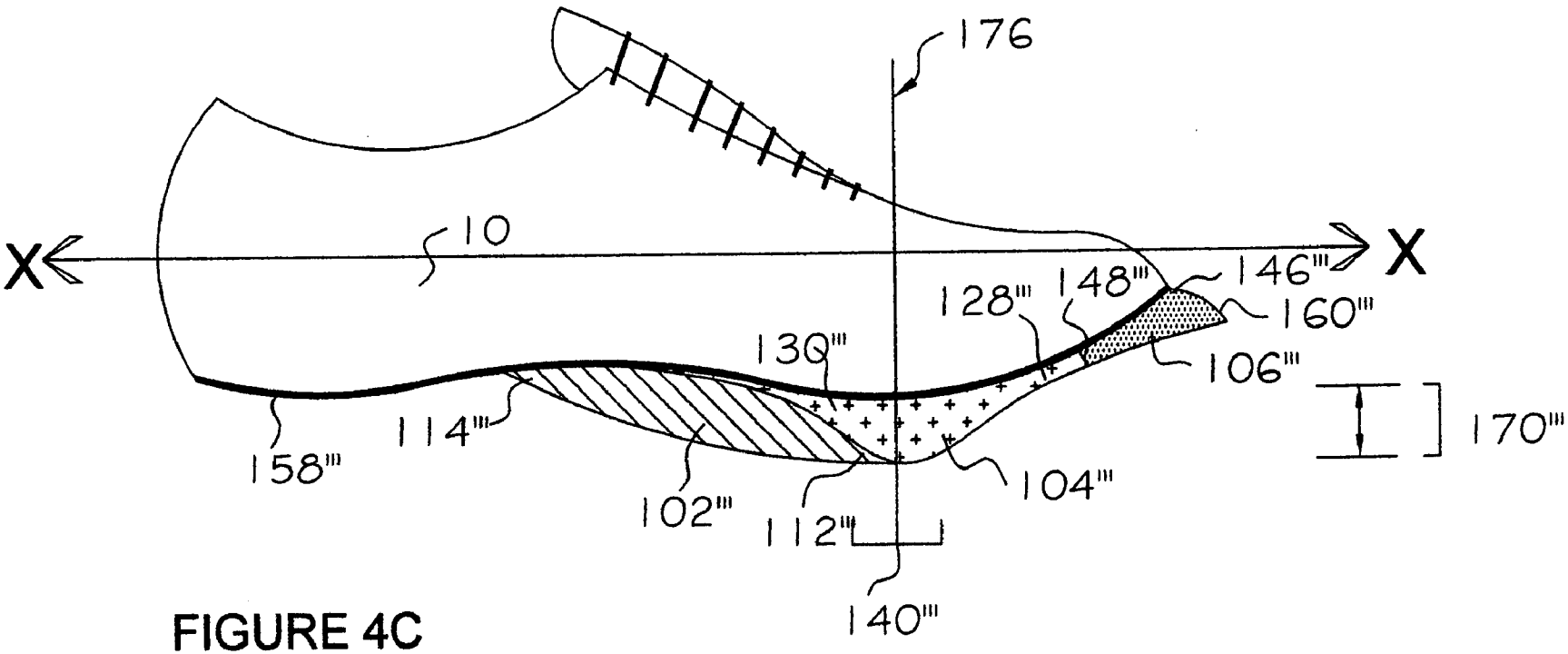
FIG. 4C shows yet another embodiment specifically designed for short-distance sprints, such as a 100 m race.
Figure 5B:
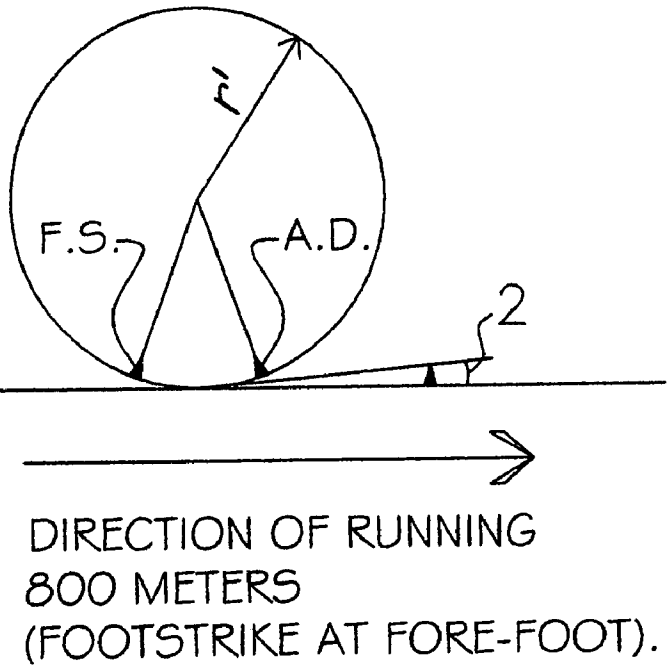
FIGS. 5A-D illustrate the correlation of foot cycle, that is from foot-strike to angular displacement point, to angle 2 of redirection of energy into maximum linear momentum for and embodiment for short-distance sprints, such as a 100 m race (5A), mid-to-long distance sprints, such as a 800 m race (5B), mid-distance running, such as a 1,500 m race (5C) and long-distance running, such as jogging (5D).
Figure 5A:
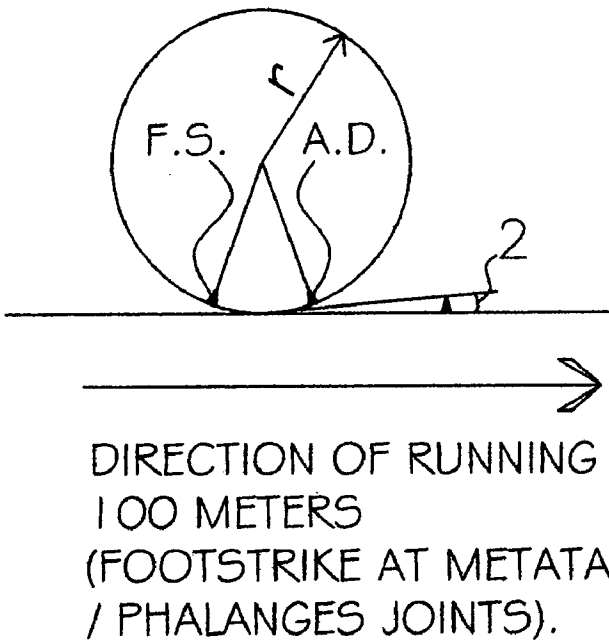
Figure 5D:
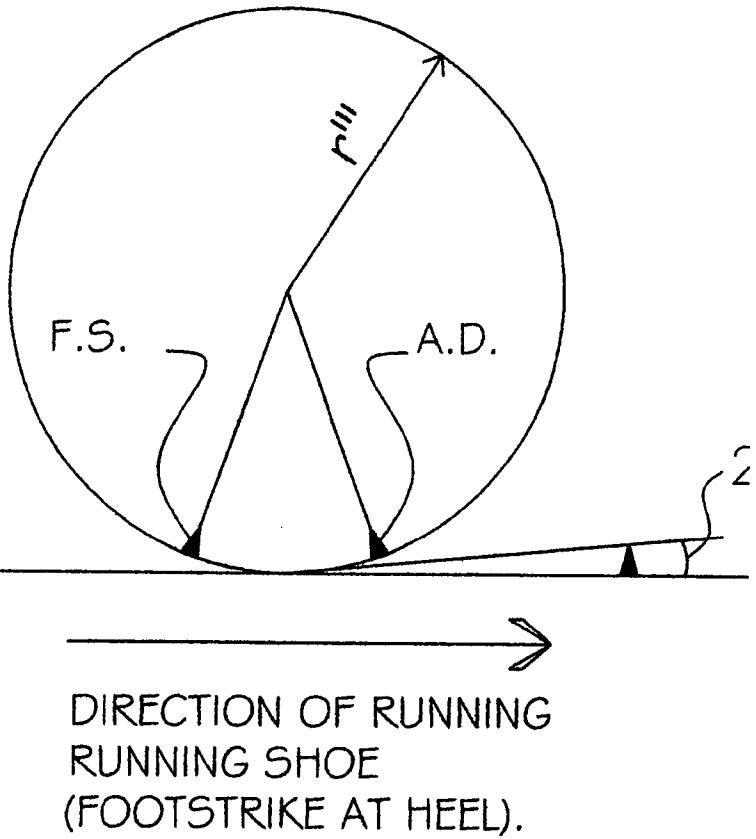
Figure 5C:
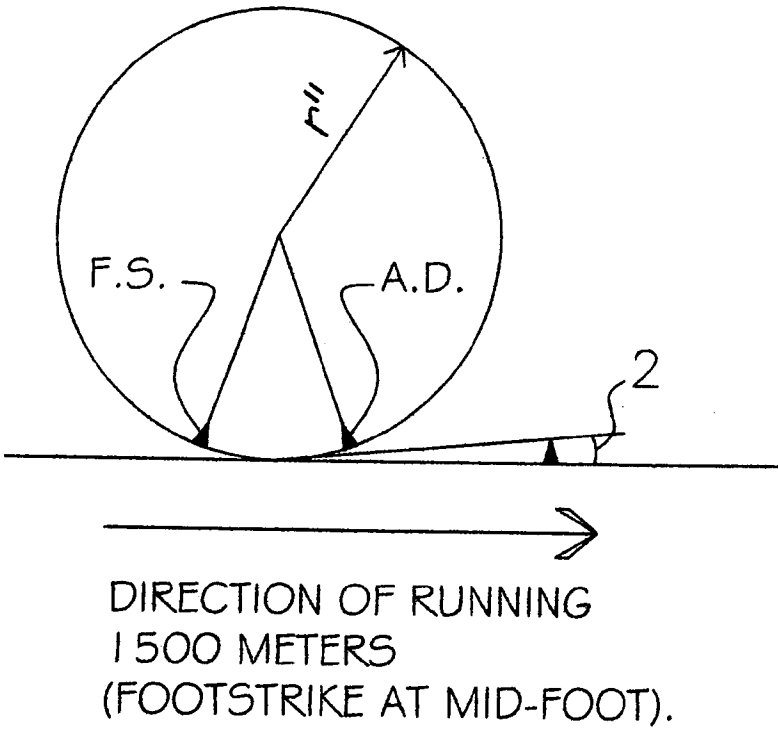

FIGS. 4A-C depict second, third and fourth embodiments of the present invention. As previously mentioned, systems and methods of the present invention are variously configured to accommodate different types of running, such as, but not limited to, long-distance running or jogging (FIG. 4A), intermediate distances, such as 1,500 m racing (FIG. 4B), mid-to-long distance sprints, such as 400 m racing (described in detail above and in FIGS. 2 and 3), and short-distance sprints, such as 100 m racing (FIG. 4C).

Kinesiological analysis of running has demonstrated different types and speeds of running involve different biomechanics. During a running cycle involving a heel-strike, such as jogging, various portions of the foot undergo a number of movements and are exposed to various forces. When foot-strike, that is heel-strike, is initiated, the foot is in supination and as contact progresses pronation permits partial absorption of impact forces. As the foot transitions from mid-support to takeoff, resupination, or transfer to the lateral ball portion of the foot occurs as the foot becomes a rigid lever. The continuous motion transfers from lateral to the medial ball of the foot as the foot accelerates through toe-off In contrast, during sprinting, the ground strike occurs in the forefoot or metatarsal area of the foot and the point of impact tends to be under or slightly behind their center of gravity. As a result, this form of running has less of the deceleration phase associated with heel-strike running and propels the body mass forward more efficiently.

Systems and methods of the present invention provide a range of embodiments to accommodate these biomechanical requirements. In general, the angle of displacement is directly related to the type and speed of running. In short, the faster the running speed, the higher the angle of displacement, as depicted by pivot zone profile 170, and the more proximal to the toe region 126 the pivot zone 140 is oriented. These salient points are most clearly illustrated by contrasting respective foot-strike 102', 102''', angular displacement member 104', 104''' and balance-thrust members 106', 106''' in a distance-running embodiment ("running shoe"—FIG. 4A) versus a short-sprint embodiment ("sprinting shoe"—FIG. 4C). As clearly illustrated, the distance-running shoe presented in FIG. 4A has a more extensive foot-strike member 102', with rear zone 114' of foot-strike member 102' extending to completely encompass heel section 120, and is substantially thicker to more effectively absorb impact forces, whereas the embodiment designed for sprinting illustrated in FIG. 4C, has a limited foot-strike member 102''' with rear zone 114''' of foot-strike member 102''' extending from the forward section of the arch region 122 into the forefoot region 124. Foot-strike member 102''' of the embodiment designed for sprinting is oriented to accommodate a running style wherein initial contact with the supporting surface is predominantly in the forefoot area of the foot. Angular displacement member 104' of the distance shoe has a lower pivot area profile 107' as compared to the angular displacement member 104''' of the sprinting shoe's pivot area profile 170'''. Additionally, angular displacement member 104'' with apex 172 for the running shoe has a larger radius in relation to angular displacement 104''' with member apex 176 for the sprinting shoe. This allows the sprinting to maintain a higher angle of displacement and faster rotation. Furthermore, balance-thrust member 106' of running shoe encompasses a greater surface area of toe section 126, and in some embodiments, front zone 160' may extend beyond toe section of upper, whereas, balance-thrust member 106''' of sprinting shoe encompasses comparatively less surface area.

During a running cycle, as the initial foot-strike makes contact with the supporting surface, there is a certain amount of supination and the foot is slightly ahead of the center of mass, which serves to minimize deceleration forces and to preserve linear forward momentum. The talocalcaneal, or subtalar, joint plays a major role in converting the rotary forces of the lower extremity into forward motion. In operation, systems and methods of the present invention build upon these natural movements by assisting foot-strike to occur at a point under and behind the center of gravity.

Following contact with the surface, the support phase is initiated, wherein the runner's body mass is fully supported. As the knee flexes to absorb impact forces and support the runner, the ankle plantar flexes and the subtalar joint pronates, causing heel pronation. Heel pronation permits absorption of compressive shock forces, torque conversion, adjustment to uneven ground contours and maintenance of balance. Eccentric tension in the posterior tibialis, soleus and gastrocnemius muscles cause deceleration of subtalar joint pronation and lower extremity internal rotation. Pronation reaches its maximum during this time and resupination is initiated to permit the foot to pass through its neutral position at the midpoint of the support phase. When the runner's center of mass is at its lowest position, a maximum vertical force is actively generated and transmitted to the supporting surface by the muscles and is often referred to as the active vertical force peak. This active vertical force peak typically reaches 2 to 8 times body weight, depending on the speed of the runner. It is during the support phase that angular displacement member 104, and more particularly, pivot region 140, engage supporting surface, initiating displacement of the runner's center of gravity. Systems and methods of the present invention serve to minimize the support phase, thereby conserving biomechanical energy by limiting energy lost to the supporting surface. Furthermore, embodiments of the present invention reduce shock and trauma to the runner by redirecting gravitational and inertial forces into linear momentum.

The support phase continues until the heel begins to rise into takeoff during the recovery phase. Generally speaking, the recovery phase is the stage of running in which muscular tension exerts vertical and horizontal forces to the support surface to propel the runner forward. During this time the foot converts from a shock-absorbing structure to a rigid lever for forward propulsion, which is largely due to changes in position of the subtalar and midtarsal joints, and in particular, supination of the subtalar joint. As the knee joint extends, the lower extremity rotates externally, the calcaneus inverts, the midtarsal joint locks, and the foot becomes a rigid lever. The propulsive force is a thrust backward and downward resulting from a combination of hip extension, knee extension and ankle plantar flexion. During the recovery phase, the rotational movement of the runner's foot undergoes a second rotational movement as the runner rolls through angular displacement and balance-thrust members 104, 106, respectively, incurring greater angular acceleration and thereby further displacing the runner's center of gravity forward and translating gravitational, inertial, ground reaction, and muscular tension forces into linear momentum.

These principles are more clearly presented in FIGS. 5A-D, which illustrate the correlation of a foot cycle, herein defined as being from initial foot-strike to angular displacement point, to angle 2 of redirection of energy into maximum linear momentum. In general, the angle 2 of displacement required for maximal redirection of energy is directly related to the type and speed of running and the faster the running speed, the greater the angle of displacement becomes. For example, embodiments designed for short-distance sprints, such as a 100 m race (FIG. 5A) have a comparatively low foot cycle radius (r), whereas embodiments designed for long-distance running (FIG. 5D) have a relatively large foot cycle radius (r'''). Furthermore, foot cycle radius (r) is inversely proportional to the angle 2 of redirection of energy. In other words, embodiments designed for short-distance sprinting (FIG. 5A) require a larger angular displacement profile 170.

Figure 6:
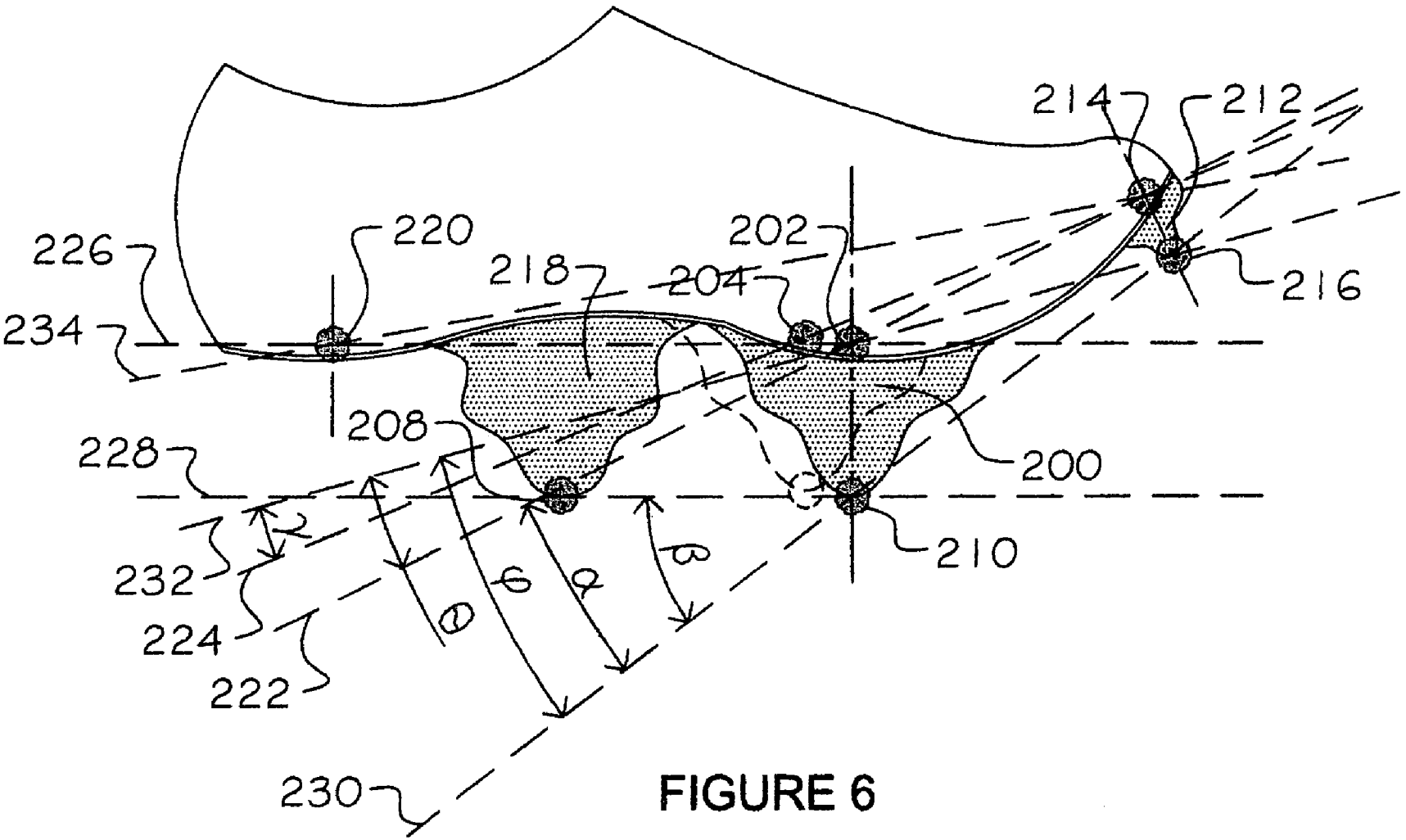
FIG. 6 is a side view of an additional embodiment of the shoe sole version with a balance thrust member, showing the relative angles and positioning of the various elements.

Another preferred embodiment of the shoe sole version is shown in FIG. 6 and is described as follows:

A displacement member 200 ("DM") is located on the bottom of the shoe and extending downward from the lower surface of the shoe.

Line 222 is a line drawn through the point 214 on the upper interior surface of the plantar surface of the shoe located at a point 6% of the length of the shoe from the front of the shoe and the point 202 on the of the medial side of the shoe located on the upper interior surface of the plantar surface at a point 31% of the length of the shoe from the front of the shoe.

Line 224 is a line drawn through the point 214 on the upper interior surface of the plantar surface of the shoe located at a point 6% of the length of the shoe from the front of the shoe and the point 204 on the of the lateral side of the shoe located on the upper interior surface of the plantar surface at a point 33% of the length of the shoe from the front of the shoe.

Line 226 is a line drawn through the point 202 on the upper interior surface of the plantar surface of the shoe located on the of the medial side of the shoe 31% of the length of the shoe from the front of the shoe and the point 220 located on the upper interior surface of the plantar surface of the shoe located at a point 87% of the length of the shoe from the front of the shoe.

The lowest point on the DM on the perpendicular to line 226 is the displacement point 210 ("DP"). The DP is located along the length of the shoe such that the DP is between one-quarter and one half of the distance between the front of the toe section and the back of the heel section of the shoe as measured along line 226. Line 228 is a line drawn parallel to line 226 and passing through the DP.

The preferred embodiment utilizes more than one displacement member 200 ("DM") located on the bottom of the shoe and extending downward from the lower surface of the shoe. When there are multiple DMs, the lowest point on the DM on medial side of the centerline measured perpendicular to line 226 is the medial displacement point 210 ("Medial DP"). The lowest point on the DM on lateral side of the centerline-measured perpendicular to line 226 is the lateral displacement point ("Lateral DP"). The Medial DP is at the same level or lower than the Lateral DP. The DP is located along the length of the shoe such that the DP is between one-quarter and one half of the distance between the front of the toe section and the back of the heel section of the shoe as measured along line 226. The Medial DP is the same or less distance from the front of the shoe than the Lateral DP.

A balance thrust member 212 ("BTM") extends downward from the toe portion of the shoe and is located longitudinally forward of the DP. The BTM has a balance thrust point 216 ("BTP") located at the lowest part of the BTM as measured on a perpendicular to line 222.

Line 218 is a line parallel to line 216 and running through the Medial DP. Line 230 is a line drawn through the displacement point 210 ("DP") and the balance thrust point 216 ("BTP").

Line 232 is a line drawn through the 216 BTP and the point located at the intersection of the medial side of the shoe located on the upper interior surface of the plantar surface and a line drawn perpendicular to 226 and running through the DP. Line 234 is a line drawn through point 214 and point 220.

A counter rotation member 218 ("CRM") extends downward from the bottom of the shoe. The CRM has a counter rotation point ("CRP") which is the lowest point on the CRM as measured on a perpendicular to line 226. The CRM is located along the length of the shoe such that the CRP is behind the DP by at least 2% of the length of the shoe measured along line 226. Line 228 is a line drawn through the CRP. The CRP must be located between on or between lines 228 and 222.

In order to obtain the advantages of the invention, that is, enhancing forward momentum and reducing energy loss, certain angles must maintain a certain relationship to each other. $\alpha$ is the angle between lines 222 and 230, $\beta$ is the angle between lines 228 and 230, $\theta$ is the angle between lines 222 and 232, $\gamma$ is the angle between lines 224 and 232, and $\phi$ is the angle between lines 232 and 230. $\alpha$ must be between zero degrees and 45 degrees, less than $\beta$, greater than $\theta$, and less than $\phi$. Also, $\gamma$ must be less than $\theta$.

Figure 7:
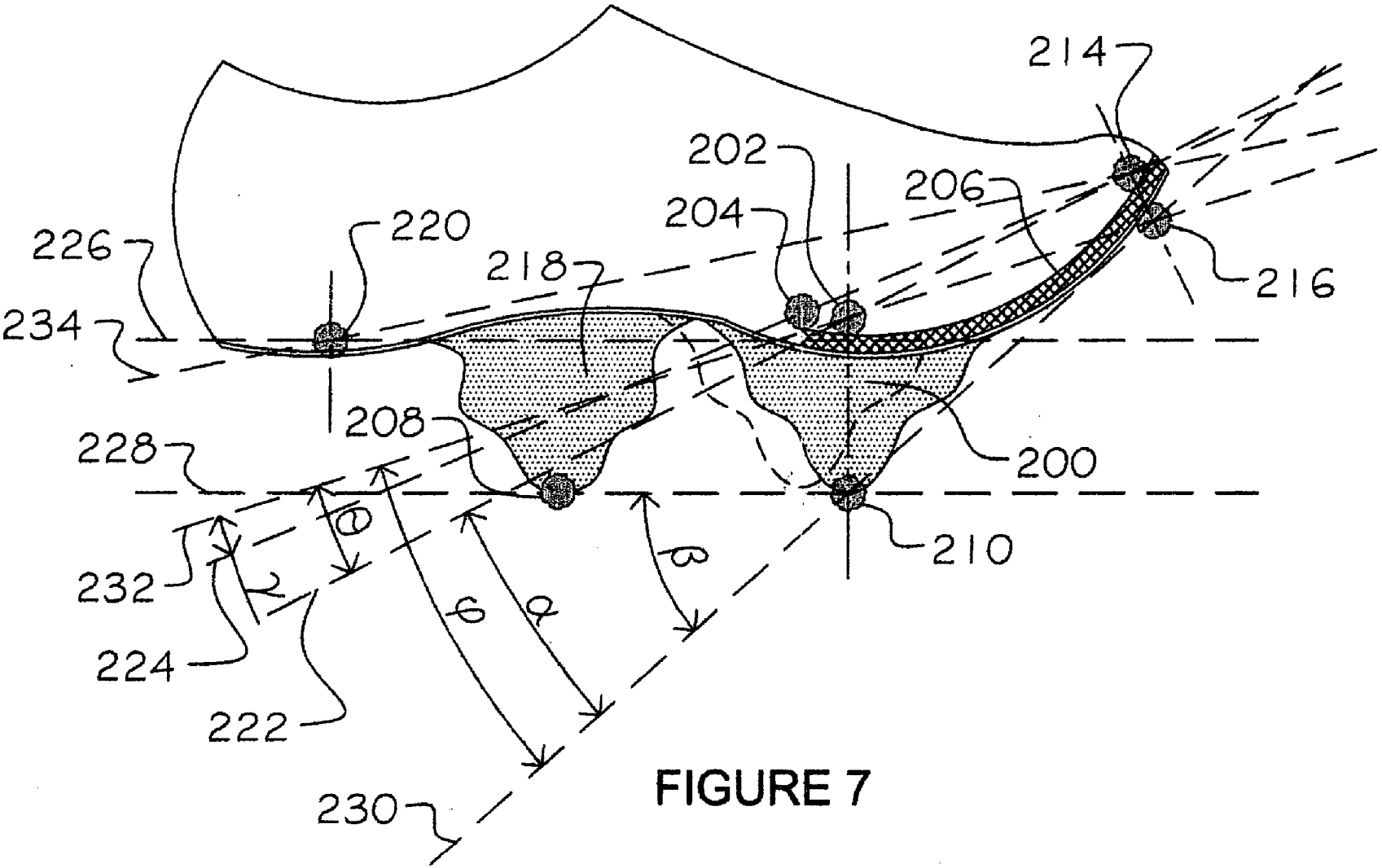
FIG. 7 is a side view of an additional embodiment of the shoe sole version with a rigid forward section instead of a balance thrust member, showing the relative angles and positioning of the various elements.

Another preferred embodiment of the shoe sole version is shown in FIG. 7 and is described as follows:

The version shown in FIG. 7 is the same as that shown in FIG. 6, except that it includes a rigid portion 206 (also referred to in the claims as the "rigidifying element") running from at least as far back as the point on the of the lateral side of the shoe located on the upper interior surface of the plantar surface at a point above the DP as measured along a line perpendicular to line 226, and continuing to the front of the toe section and being continuously radiused upward going toward the front of the toe section 214. The rigid portion 206 is made of material sufficiently rigid to prevent deformation of such portion 202 during use.

When the rigid portion 206 is included, thereby maintaining the upward curved shape of the front portion of the shoe, then a BTM is not required, but rather is optional. If a BTM is used, then definitions of the lines, angles, and distances, and their relation to each other, are the same as in the embodiment shown in FIG. 6.

If a BTM is not used (the way shown in FIG. 7), then the BTP 216 is located on the rigid surface and line 230 is defined as a line drawn through point 210 located at the lowest point on the DM on the perpendicular to line 226 and the point 208 on the bottom surface of plantar surface of the shoe located 6% of the length of the shoe from the front of the shoe measured along line 226. Otherwise, all definitions of the lines, angles, and distances, and their relation to each other, are the same as in the embodiment shown in FIG. 6.

Figure 8:
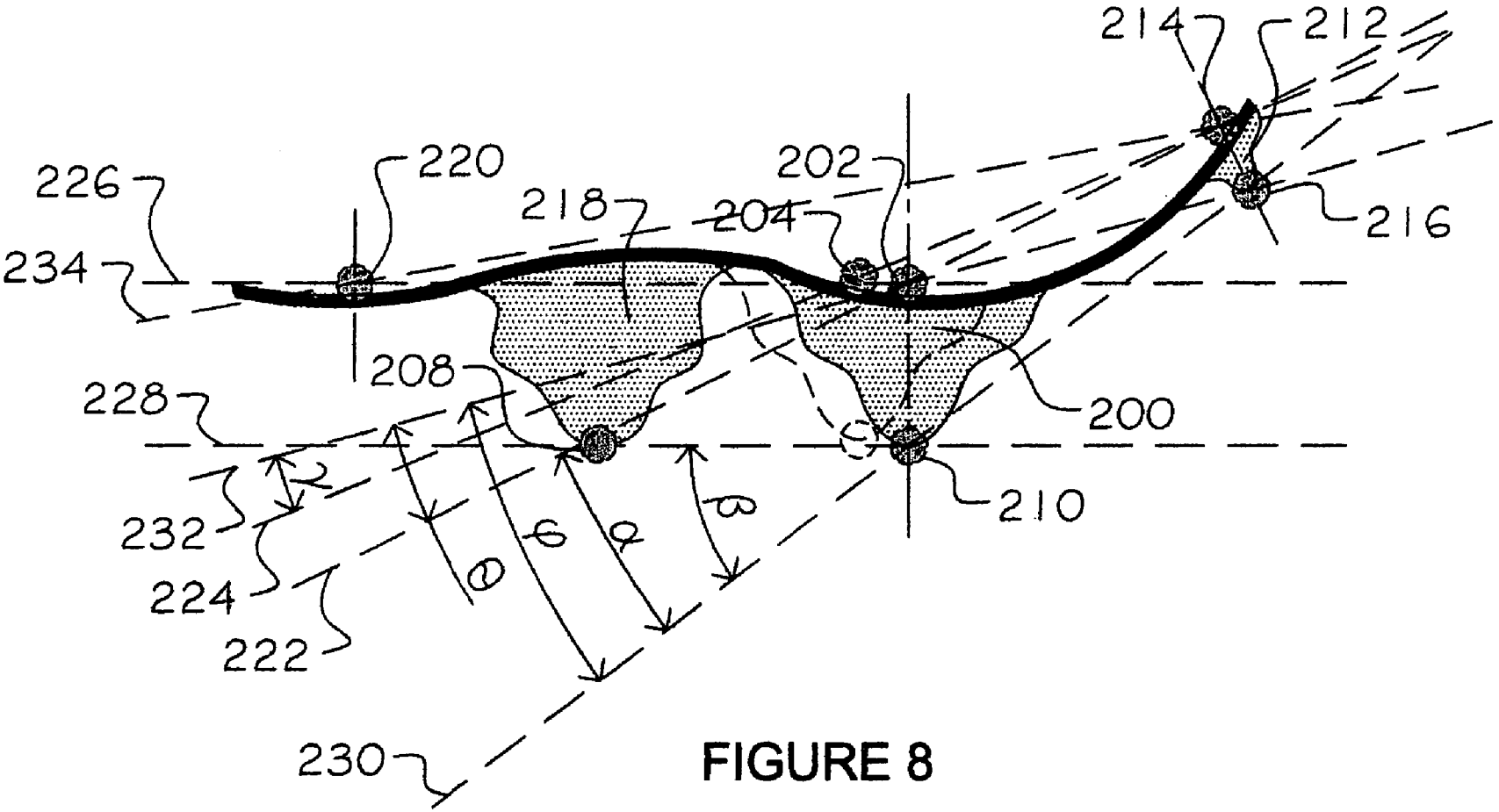
FIG. 8 is a side view of an additional embodiment of the shoe insert version with a balance thrust member, showing the relative angles and positioning of the various elements.

A preferred embodiment of the shoe insert version not having a rigid forward section is shown in FIG. 8 and is described as follows:

The version shown in FIG. 8 has generally the same DM, CRM, and BTM as that shown in FIG. 6, except that in FIG. 8, they extend downward from a thin insert designed to be placed inside a shoe, instead of extending downward from the outer sole of the shoe. Otherwise, the definitions of the lines, angles, and distances, and their relation to each other, are the same as in the embodiment shown in FIG. 6. Because of the need to fit inside the shoe, the range of thickness for the DM, CRM, and BTM is less for the insert shown in FIG. 8 than in the shoe sole shown in FIG. 6.

Figure 9:
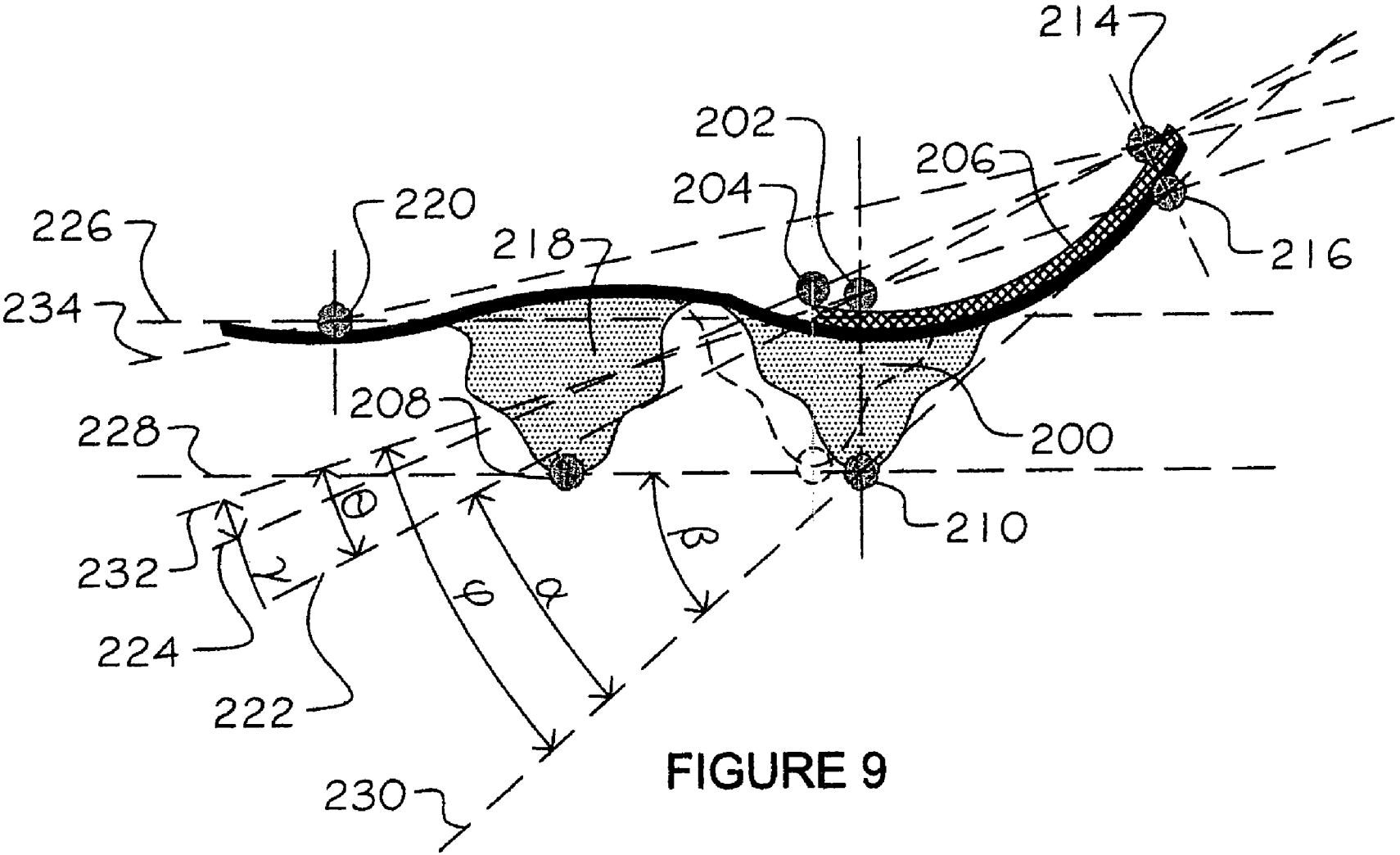
FIG. 9 is a side view of an additional embodiment of the shoe insert version with a rigid forward section instead of a balance thrust member, showing the relative angles and positioning of the various elements.

A preferred embodiment of the shoe insert version having a rigid forward section is shown in FIG. 9 and is described as follows:

The version shown in FIG. 9 has generally the same DM, CRM, and rigid forward section as those shown in FIG. 7, except that in FIG. 9, the DM and CRM extend downward from a thin insert designed to be placed inside a shoe, instead of extending downward from the outer sole of the shoe. Likewise, the rigid forward section is a part of the forward portion of the insert in FIG. 9, whereas in FIG. 7 the rigid section is part of the forward section of the shoe sole. Otherwise, the definitions of the lines, angles, and distances, and their relation to each other, are the same as in the embodiment shown in FIG. 7. Because of the need to fit inside the shoe, the range of thickness for the DM, CRM, and BTM is less for the insert shown in FIG. 9 than in the shoe sole shown in FIG. 7.

In the version shown in FIG. 9, the use of a BTM is optional. If a BTM is not used (the way shown in FIG. 9), then the BTP 216 is located on the rigid surface and line 230 is defined as a line drawn through point 210 located at the lowest point on the DM on the perpendicular to line 226 and the point 208 on the bottom surface of plantar surface of the shoe located 6% of the length of the shoe from the front of the shoe measured along line 226. Otherwise, all definitions of the lines, angles, and distances, and their relation to each other, are the same as in the embodiment shown in FIG. 6.

In each of the embodiments shown in FIGS. 6-9, there may be more than one DM on each shoe sole or shoe insert, there may be more than one CRM on each shoe sole or shoe insert, and there may be more than one BTM on each shoe sole or shoe insert. Alternatively, each DM, CRM, and/or BTM may be split into two or more portions. In fact, in one preferred embodiment, each shoe sole or shoe insert has two DMs, one on the medial side and one on the lateral side, and each with a DP. In this version, the medial side DP is closer to the front of the shoe than the lateral side DP. The CRM is then placed in the middle of the shoe. For purposes of reducing weight, the DMs and CRM are fairly narrow and do not span the width of the shoe sole or shoe insert.

As another example, the DM(s) may have a number of DPs running from the medial side to the lateral side of the shoe sole or shoe insert, preferably in a continuous curve, and moving generally toward the front of the shoe sole or shoe insert as they move from the lateral side to the medial side of the shoe.

As another example, the DMs, CRMs, and/or BTMs can each be made of a plurality of rib elements. The DM can be made of a plurality of rib elements oriented along the sesamoidal line to facilitate fore-aft pivoting of the foot of a wearer about the sesamoidal line.

While the sole units and inserts of the foregoing embodiments may be shown isolated from an entire shoe or sole, from the following details, persons skilled in the art will be capable of integrating the disclosed sole unit into a complete shoe or sole using known techniques.

While in the foregoing specification this invention has been described in relation to certain preferred embodiments thereof, and many details have been set forth for purpose of illustration, it will be apparent to those skilled in the art that the invention is susceptible to various changes and modification as well as additional embodiments and that certain of the details described herein may be varied considerably without departing from the basic spirit and scope of the invention.

What I claim:

1. A shoe sole unit comprising,

One or more displacement members located on the bottom of the shoe and extending downward from the lower surface of the shoe, wherein each displacement member has a displacement point located between one-quarter and one half of the distance between the front of the toe section and the back of the heel section of the shoe sole and located vertically at the lowest point on the displacement member on the perpendicular to a first imaginary line passing through the point on the upper interior surface of the plantar surface of the shoe sole located on the medial side of the shoe sole between 25% and 40% of the length of the shoe sole from the front of the shoe sole and the point located on the upper interior surface of the plantar surface of the shoe sole located at a point 75% to 95% of the length of the shoe sole from the front of the shoe sole, wherein the number of displacement points is two, one on the medial side and one on the lateral side of the shoe sole, and wherein the angle between the second and third lines is less than the angle between the third line and a fourth imaginary line passing through the point on the upper interior surface of the plantar surface of the shoe sole located at a point 6% of the length of the shoe sole from the front of the shoe sole and the point on the of the lateral side of the shoe sole located on the upper interior surface of the plantar surface at a point 33% of the length of the shoe sole from the front of the shoe sole, and less than the angle between the third line and a fifth imaginary line parallel to the first line and passing through the displacement point.

2. A shoe sole unit comprising,

One or more displacement members located on the bottom of the shoe and extending downward from the lower surface of the shoe, wherein each displacement member has a displacement point located between one-quarter and one half of the distance between the front of the toe section and the back of the heel section of the shoe sole and located vertically at the lowest point on the displacement member on the perpendicular to a first imaginary line passing through the point on the upper interior surface of the plantar surface of the shoe sole located on the medial side of the shoe sole between 25% and 40% of the length of the shoe sole from the front of the shoe sole and the point located on the upper interior surface of the plantar surface of the shoe sole located at a point 75% to 95% of the length of the shoe sole from the front of the shoe sole, further comprising a balance thrust member located closer to the front of the shoe sole than the displacement point and having a balance thrust point located at the lowest part of the balance thrust member as measured on a perpendicular to the second line, and wherein the angle between the second and third lines is less than the angle between the fifth and third lines, greater than the angle between the second line and a seventh imaginary line passing through the balance thrust point and the point located at the intersection of the medial side of the shoe sole located on the upper interior surface of the plantar surface and a line drawn perpendicular to the first line and running through the displacement point, and less than the angle between the seventh and third lines.

3. The apparatus of claim 2, wherein the angle between the second and third lines is less than the angle between the fifth and third lines, less than the angle between the seventh and third lines, and greater than the angle between the second and seventh lines, wherein the angle between the seventh and third lines is greater than the angle between the second and third lines, and wherein the angle between said fourth and seventh lines must be less than the angle between said second and seventh lines.

4. A method of making a shoe comprising, providing a sole unit, the sole unit comprising:

One or more displacement members located on the bottom of the sole unit and extending downward from the lower surface of the sole unit, each displacement member having a displacement point located between one-quarter and one half of the distance between the front of the toe section and the back of the heel section of the sole unit and located vertically at the lowest point on the displacement member on the perpendicular to a first imaginary line passing through the point on the upper interior surface of the plantar surface of the sole unit located on the medial side of the sole unit between 25% and 40% of the length of the sole unit from the front of the sole unit and the point located on the upper interior surface of the plantar surface of the sole unit located at a point 75% to 95% of the length of the shoe sole from the front of the sole unit, wherein the angle between a second imaginary line passing through the point on the upper interior surface of the plantar surface of the sole unit located at a point 6% of the length of the sole unit from the front of the sole unit and the point on the of the medial side of the sole unit located on the upper interior surface of the plantar surface at a point 31% of the length of the sole unit from the front of the sole unit and a third imaginary line passing through the displacement point at the lowest point of the displacement member as measured perpendicular to the first line and a line passing through a point approximately 6% of the length of the sole unit from the front of the shoe sole and perpendicular to the second line is between zero degrees and 45 degrees, wherein the angle between the second and third lines is less than the angle between the third line and a fourth imaginary line passing through the point on the upper interior surface of the plantar surface of the sole unit located at a point 6% of the length of the sole unit from the front of the sole unit and the point on the of the lateral side of the sole unit located on the upper interior surface of the plantar surface at a point 33% of the length of the sole unit from the front of the sole unit, and less than the angle between the third line and a fifth imaginary line parallel to the first line and passing through the displacement point, adding a counter rotation member that extends downward from the bottom of the sole unit and that has a counter rotation point which is the lowest point on the counter rotation member as measured perpendicular to the first line, and wherein said counter rotation member is located along the length of the sole unit such that the counter rotation point is farther from the front of the sole unit than the displacement point and on or between said second and fifth lines, wherein the angle between the second and third lines is less than the angle between the fifth and third lines and less than the angle between the seventh and third lines, providing an upper for covering at least a portion of a top surface of a wearer's foot; and physically associating the sole unit with the upper.

5. The method of claim 4 further comprising providing a balance thrust member located closer to the front of the sole unit than the displacement point and having a balance thrust point located at the lowest part of the balance thrust member as measured on a perpendicular to said first line.

6. The method of claim 5 further comprising making the plantar surface of the sole unit sufficiently rigid to prevent deformation during use from at least as far back as the point on the of the lateral side of the shoe located on the upper interior surface of the plantar surface at a point above the displacement member as measured along a line perpendicular to the first line and continuing to the front of the toe section and causing it to be continuously radiused upward going toward the front of the toe section.

* * * * *